United States Patent [19]

Spitzer

[11] Patent Number: 4,767,456

[45] Date of Patent: Aug. 30, 1988

[54] CORROSION AND WEAR RESISTANT METAL ALLOY HAVING HIGH HOT HARDNESS AND TOUGHNESS

[75] Inventor: Ronald F. Spitzer, Jamestown, N.Y.

[73] Assignee: MRC Bearings Incorporated, Jamestown, N.Y.

[21] Appl. No.: 30,431

[22] Filed: Mar. 26, 1987

Related U.S. Application Data

[63] Continuation-in-part of Ser. No. 835,981, Mar. 4, 1986, abandoned, which is a continuation of Ser. No. 625,439, Jun. 28, 1984, abandoned.

[51] Int. Cl.[4] ..... C22C 29/00

[52] U.S. Cl. ..... 75/246; 75/243; 419/11; 419/49

[58] Field of Search ..... 75/243, 246; 419/49, 419/11

[56] References Cited

U.S. PATENT DOCUMENTS

| | | | |
|---|---|---|---|
| 3,694,173 | 9/1972 | Farmer et al. | 75/246 |
| 4,233,073 | 11/1980 | Takemura | 75/246 |
| 4,648,903 | 3/1987 | Ikenoue et al. | 75/246 |

*Primary Examiner*—Stephen J. Lechert, Jr.
*Attorney, Agent, or Firm*—Eugene E. Renz, Jr.

[57] ABSTRACT

A corrosion and wear resistant sintered powdered metal alloy having a density of at least 99.9 percent of theoretical density is provided. The alloy comprises, in weight percent, from about 13 to about 17 percent chromium, from about 5.5 to about 8.5 percent molybdenum, from about 1.25 to about 2.5 percent vanadium, and from about 1.2 to about 1.65 percent carbon, with the balance being iron plus trace elements. The foregoing alloy is used to produce corrosion and wear resistant bearings which are characterized by high hot hardness and toughness.

13 Claims, No Drawings

CORROSION AND WEAR RESISTANT METAL ALLOY HAVING HIGH HOT HARDNESS AND TOUGHNESS

This is a continuation-in-part of pending application filed Mar. 4, 1986 bearing Ser. No. 835,981 and entitled CORROSION AND WEAR RESISTANT METAL ALLOY HAVING HIGH HOT HARDNESS AND TOUGHNESS, now abandoned, which is a continuation of application filed June 28, 1984 bearing Ser. No. 625,439 and entitled CORROSION AND WEAR RESISTANT METAL ALLOY HAVING HIGH HOT HARDNESS AND TOUGHNESS, now abandoned.

FIELD OF THE INVENTION

The present invention relates to a unique powdered metal alloy which is especially useful in the fabrication of bearings intended for use at elevated temperatures.

BACKGROUND OF THE INVENTION

The instant invention concerns a corrosion and wear resistant ferrous base alloy composition which contains essential amounts of chromium, molybdenum, vanadium, and carbon, and optionally, silicon, manganese columbium and/or boron.

Numerous ferrous base alloy compositions are known and used in the fabrication of various types of bearings. Generally, such alloys are produced by conventional metal forming techniques, such as casting and hot working. However, when one attempts to utilize conventional procedures to produce a ferrous base alloy composition from the above enumerated ingredients, difficulties are often experienced.

One of the major impediments preventing the design in production of aircraft engines of increased engine performance and efficiency is the inability of the designs to operate at higher temperatures and speeds. This inability is caused by a lack of bearings which are capable of withstanding the softening effect and increased oxidation associated with high temperature.

It has been demonstrated that rolling contact fatigue life of bearings is significantly reduced when the hardness of the bearing components are reduced from hardness levels of Rockwell C60. When the hardness is compared with a bearing's dynamic capacity, as hardness drops from a ideal of 100 percent of capacity at Rockwell C of 64, the percentage of capacity drops below 90% as the hardness dips below 60. As hardness goes to as low as RC57 or lower, the capacity reaches only 50 percent of maximum. Clearly, the implications of this are that the candidate for a bearing alloy must exhibit high hardness and not only at room temperature but also at the high elevated temperatures which correspond to present and future operating conditions for engines.

While room temperature hardness of a bearing alloy is determined by the carbon content of the matrix, with at least 0.65 percent carbon being necessary to achieve adequate room temperature hardness, hot hardness is determined by other factors.

Another major cause for rejection and/or removal of aircraft engine bearings from service is the effect of corrosion. Corrosion results in significant increases in the aggregate bearing costs, reflecting both high maintenance costs and premature replacement costs.

Corrosion can result from inadequate preservation during storage and can also be caused by the corrosive effects associated with oil or lubricant contamination and/or degradation. Higher engine operating temperatures tend to increase the chemical degradation of either oil or lubricants thereby increasing the corrosive effect upon bearing components. It is a commonly accepted fact that corrosion resistance of bearing alloys is substantially increased by the addition of chromium, with a base threshold level of at least 12 percent chromium being necessary to provide effective corrosion resistance. Increase in the chromium level above 12 percent provides increased corrosion resistance.

Another important criterion for determining the acceptability of bearing material candidates is its ability to resist wear. This becomes of paramount importance when high-speed engine bearings operate, as they are subject to "fretting" wear. With every increasing tendencies towards higher engine speeds, bearings are now called to operate at rotational speeds which approach 3 million DN. This method of measuring rotational speed is calculated by multiplying the diameter D of the bore in mm by the rotation rate N in RPM. At these higher operating speeds, bearing toughness or resistance to crack propagation and fracture becomes increasingly more critical. Many exotic alloys and ceramic materials are resistant to corrosion and have adequate hardness but are brittle and fracture or do not wear well.

Accordingly, it is an object of the present invention to provide a corrosion and wear resistant ferrous base alloy composition which exhibits a high degree of hot hardness, toughness and wear resistance.

Another object of the invention is to provide a unique ferrous base alloy composition which is ideally suited as a material of construction for the fabrication of bearings which are intended for use at ambient, cryogenic or elevated temperatures.

These and other objects of the present invention will be apparent to those skilled in the art from a reading of the following specification and claims.

SUMMARY OF THE INVENTION

In one aspect, the present invention concerns a corrosion and wear resistant powdered metal alloy having a density of at least 99.9 percent of theoretical density which comprises, in weight percent, from about 13 to about 17 percent chromium, from about 5.5 to about 8.5 percent molybdenum, from about 1.25 to about 2.5 percent vanadium, with the balance being iron plus trace elements.

In still another aspect, the present invention concerns a bearing structure formed from a powdered metal alloy having a density of at least 99.9 percent of theoretical density which comprises, in weight percent, from about 13 to about 17 percent chromium, from about 5.5 to about 8.5 molybdenum, from about 1.25 to about 2.5 percent vanadium, with the balance being iron plus trace elements.

In still another aspect, the present invention concerns a method of producing a powdered metal bearing structure which comprises providing a particulate material consisting essentially of, in weight percent, from about 13 to about 17 percent chromium, from about 5.5 to about 8.5 percent molybdenum, from about 1.25 to about 2.5 percent vanadium, and from about 1.2 to about 1.65 percent carbon, with the balance being iron plus trace elements; consolidating the so-obtained particulate material into a fully dense article which can be further formed by traditional metal forming means or is a near final shape requiring little or no further machining.

DETAILED DESCRIPTION OF THE PREFERRED EMBODIMENT

The alloy of the present invention is ferrous base. In this regard, as used herein, the term "ferrous base" means an alloy or composition containing more than 50 percent by weight iron.

In the practice of the instant invention, a particulate material is formed which comprises in weight percent, from about 13 to about 17 percent chromium, from about 5.5 to about 8.5 percent molybdenum, from about 1.25 to about 2.5 percent vanadium and from about 1.2 to about 1.65 percent carbon, with balance being iron plus trace elements.

As above noted, columbium and boron are not essential components of the alloy of the invention. However, it has been discovered that when either or both is added to the concerned alloy composition the hardness and toughness of the resultant alloy may be enhanced. In this regard, when columbium and/or boron are included in the alloy composition of the present invention, they are both employed in amounts ranging from a trace to about 0.15 weight percent.

In the practice of the instant invention, a composition which results in an article having excellent physical properties is one which comprises in weight percent, about 15.0 percent chromium, about 6.5 percent molybdenum, about 1.8 percent vanadium, and about 1.5 percent carbon, with the balance being iron plus trace elements.

The foregoing composition can be produced in various ways. For example, an alloy of the above composition can be formed and then comminuted into the desired particulate material. Also, the above composition can be produced by mixing together particles of the above set forth individual ingredients within the ranges specified. Obviously, combinations of the before delineated techniques can also be utilized to produce the desired alloy composition.

In practice, it is preferred to employ a pre-alloyed mixture of individual particles to produce the desired end product. Typically, ingredients are utilized which have a particle size ranging from about 100 to about 300 microns.

In practice, once a homogeneous mixture of the herein above mentioned ingredients is obtained an appropriate amount thereof is placed in a sealed container of predetermined configuration.

The sealed container is then subjected to the simultaneous application of heat and pressure so as to consolidate the particles into a fully dense body. This pressure can be applied by various means including extrusion, a forging press or hammers, compactor or hot isotatic pressing. The specific choice of a particular consolidation process is dependent to some extent upon the desired resultant form or application.

After consolidation, the resultant article can be subjected to additional metal working techniques, if desired. The finally processed article can then be readily machined to the exact dimensions desired.

The subject invention will now be described in greater detail with reference to the following examples of the preferred practice of the invention. The following examples are set forth for the purposes of illustrating the invention and is not intended to limit the same.

EXAMPLE ONE

A plurality of sealed cans were prepared, containing a powdered (100 to 300 micron particle size) alloy comprising in weight percent, from about 14 to about 16 percent chromium, from about 6 to 8 percent molybdenum, from about 1.75 to about 2.5 vanadium, with the balance being iron and trace quantities of manganese, columbium and boron. The alloys were subjected to hot isostating pressing at a pressure of at least 5000 psi at a temperature about 815 C. but below 1200 C. to achieve a density of 99.9% or greater.

The resultant articles were then physically and metallurgically examined and found to exhibit hot hardness and toughness.

In order to demonstrate the effectiveness of the present invention, a plurality of samples were compared as described above. These samples were then tested and compared with other alloys which have been proposed for use in the manufacture of bearing structures. These various alloys were also tested to determine the suitability of the material for use in modern, sophisticated environments of high stress.

Specifically, as shown below in Table I, a plurality of samples have been prepared and tested for corrosion resistance. Sample A, which represents an alloy of the present invention, contains 15% by weight chromium, 6.5 percent molybdenum, 1.8 percent vanadium and 1.5 percent carbon. The alloy is corrosion resistant. Also shown are samples B, C, D, F and G which all contain at least 14 percent by weight chromium. All of these materials are corrosion resistant. Sample E, which contains 4 percent chromium is not corrosion resistant and is unexceptable for use in many of the environments which require hard wear resistant and corrosion resistant bearing materials. Sample E, however, has been used in low corrosion environments because of its other properties, and is superior to samples B, C, D, F and G in low corrosion situations.

TABLE I

| | Corrosion Resistance | | | | |
|---|---|---|---|---|---|
| Sample | Chromium | Molybdenum | Vanadium | Carbon | Corrosion Resistant |
| A-invention | 15 | 6.5 | 1.8 | 1.5 | Yes |
| B | 14 | 2.0 | 1.0 | 1.1 | Yes |
| C | 17.5 | 2.0 | 1.0 | 1.25 | Yes |
| D | 14.5 | 4.5 | 6.0 | 2.0 | Yes |
| E | 4.0 | 4.3 | 1.0 | 0.85 | No |
| F | 17.5 | 6.5 | 5.75 | 2.2 | Yes |
| G | 14.0 | 4.0 | 2.75 | 1.15 | Yes |

Presented below in Table II are values for hardness, based upon the Rockwell C scale for three (3) samples. The first sample, representing a composition of this invention, and having the composition shown in Table I above, has a hardness at room temperature and at elevated temperatures which is admirably suited for use in difficult environments. Sample B, which has the composition shown in Table I, is also relatively satisfactory in hardness, both at room temperature and at elevated temperatures. Similarly, Sample E, which failed the corrosion resistance test shown in Table I, has an adequate hardness at both room temperature and at elevated temperatures. The slight degree of improvement by the Sample A, representing the present invention, is not by itself seen to be a major determining factor in the selection of the alloy. None of the other samples in Table I have hardness values as good as those shown in Table II.

TABLE II

| Sample | Hardness, Rockwell C Scale Rc, room temp. | Rc, 400° F. | Rc, 500° F. |
|---|---|---|---|
| A-invention | 62.1 | 60.0 | 60.0 |
| B | 60.0 | 59.3 | 58.7 |
| E-not corrosion resistant | 60.9 | 60.0 | 58.7 |

As shown in Table III presented below, wear resistance has been measured. To evaluate wear resistance of the various samples, a cross cylinder wear apparatus was constructed. Essentially, a half inch diameter cylinder was rotated against a fixed ½ inch diameter rod with axes inclined 90° to each other. The specimen size were uniform and the rotating speed was maintained at 1200 RPM. An applied load of 25 pounds on the load arm was used and the test lasted for 5 minutes. The effective load on the contact was 53 pounds, due to mechanical advantage of the rig and weight of the load arm. This resulted in a maximum Hz stress at the start of a test of 340,000 PSI. Stress reduced rapidly, but at an indeterminent rate as where increased the contact area. The rotating bar produced an eliptical wear scar on the stationary bar. In each experiment, like materials were run together.

TABLE III

| Sample | Wear Resistance Wear resistance, grams | Remarks |
|---|---|---|
| A | 0.0021 | invention |
| B | 0.07 | |
| C | 0.08 | |
| D | 0.040 | |
| E | 0.0073 | not corrosion resistant |
| F | 0.05 | |
| G | 0.06 | |

As is evident from the data in Table III, the Sample A representing the invention produced a significantly lower wear factor than did any of the other samples tested. Specifically, the wear resistance was almost 3.5 times better than the next best sample, Sample E, which it must be remembered is not corrosion resistant. For those samples which are corrosion resistant and which have hardness in the same range as the sample representing the invention, the wear resistance of the present invention sample was from about 20 to almost 40 times more effective as a wear resistant material. The other samples, which have their composition shown in Table I above, are surprisingly much inferior in resisting wear and accordingly, would be much less suitable in the environment for which these materials are intended.

While there have been described herein what are at present considered to be the preferred embodiments of this invention, it will be apparent to those skilled in the art that various changes and modifications may be made without departing from the invention, and it is therefore, intended in the appended claims to cover all such changes and modifications as fall within the true spirit and scope of the invention.

What is claimed is:

1. A corrosion resistant, high hardness and wear resistant alloy having a density of at least a 99.9 percent of theoretical density, comprising, in weight percent from about 13 to about 17 percent chromium; from about 5.5 to about 8.5 percent molybdenum; from about 1.2 to about 1.65 percent carbon; and from about 1.25 to about 2.5 percent vanadium.

2. The alloy of claim 1, wherein, in weight percent chromium is present in about 15 percent, molybdenum is present in about 6.5 percent, vanadium is present in about 1.8 percent and carbon is present in about 1.5 percent, with the balance being iron plus trace elements.

3. The alloy of claim 1, wherein columbium is present in weight percent, in an amount ranging from about a trace to about 0.15 percent.

4. The metal alloy of claim 1, wherein boron is present, in weight percent, in an amount ranging from about a trace to about 0.15 percent.

5. A bearing structure formed from centered powdered metal alloy having a density of at least 99.9 percent of theoretical density which comprises, in weight percent, from about 13 to about 17 percent chromium, from about 5.5 to about 8.5 percent molybdenum, from about 1.25 to about 2.5 percent vanadium and from about 1.2 to about 1.65 percent carbon, with the balance being iron plus trace elements.

6. The bearing structure of claim 5, wherein, in weight percent, chromium is present in about 15 percent, molybdenum is present in about 6.5 percent, vanadium is present in about 1.8 percent, carbon is present in about 1.5 percent, and the balance is iron plus trace elements.

7. The bearing structure of claim 5, wherein columbium is present, in weight percent, in an amount ranging from about a trace to about 0.15 percent.

8. The bearing structure of claim 5, wherein boron is present, in weight percent, in an amount ranging from about a trace to about 0.15 percent.

9. A method for producing a powdered metal bearing structure which comprises:

providing a particulate material comprising, in weight percent, from about 13 to about 17 percent chromium, from about 5.5 to about 8.5 percent molybdenum, from about 1.25 to about 2.5 percent vanadium, and from about 1.2 to about 1.65 percent carbon, with the balance being iron plus trace elements;

forming the so obtained mixture into an article of the desired configuration; and subjecting the so-formed article to a consolidation treatment to produce an article having desired alloy composition and density of at least 99.9 percent of theoretical.

10. The method of claim 9 wherein, in weight percent, chromium is present in about 15 percent, molybdenum is present in about 6.5 percent, vanadium is present in about 1.8 percent and carbon is present in about 1.5 percent, with the balance being iron plus trace elements.

11. The method of claim 9 wherein columbium is present, in weight percent, in an amount ranging from about a trace to about 0.15 percent.

12. The method of claim 9 wherein boron is present, in weight percent, in an amount ranging from about a trace to about 0.15 percent.

13. The method of claim 9 wherein said consolidation treatment is accomplished by means of hot isotactic pressing.

* * * * *